US010702008B2

(12) United States Patent
Hughes et al.

(10) Patent No.: US 10,702,008 B2
(45) Date of Patent: Jul. 7, 2020

(54) DEVICE AND METHOD OF CONSTRUCTING SHOES

(71) Applicant: HBN SHOE, LLC, Salem, NH (US)

(72) Inventors: Brian G. R. Hughes, San Antonio, TX (US); Howard Dananberg, Stowe, VT (US)

(73) Assignee: HBN SHOE, LLC, Salem, NH (US)

( * ) Notice: Subject to any disclaimer, the term of this patent is extended or adjusted under 35 U.S.C. 154(b) by 195 days.

(21) Appl. No.: 15/905,482

(22) Filed: Feb. 26, 2018

(65) Prior Publication Data

US 2019/0261732 A1 Aug. 29, 2019

(51) Int. Cl.

| | |
|---|---|
| ***A43B 7/14*** | (2006.01) |
| ***A43B 17/00*** | (2006.01) |
| ***A43B 23/07*** | (2006.01) |
| ***A43B 3/10*** | (2006.01) |
| ***A43B 7/22*** | (2006.01) |
| ***A43B 7/28*** | (2006.01) |
| ***A43B 3/12*** | (2006.01) |

(52) U.S. Cl.

CPC ..... *A43B 7/141* (2013.01); *A43B 3/10* (2013.01); *A43B 3/12* (2013.01); *A43B 7/14* (2013.01); *A43B 7/144* (2013.01); *A43B 7/1405* (2013.01); *A43B 7/1415* (2013.01); *A43B 7/1425* (2013.01); *A43B 7/1445* (2013.01); *A43B 7/223* (2013.01); *A43B 7/28* (2013.01); *A43B 17/00* (2013.01); *A43B 23/07* (2013.01)

(58) Field of Classification Search

CPC ..... A43B 7/141; A43B 7/14; A43B 7/1405; A43B 7/1415; A43B 7/1425; A43B 7/144; A43B 7/1445

USPC ..... 36/42, 43, 142, 143, 144, 145

See application file for complete search history.

(56) References Cited

U.S. PATENT DOCUMENTS

| | | | |
|---|---|---|---|
| 73,924 | A | 1/1868 | Pickett |
| 975,576 | A | 11/1910 | Sexton |
| 1,055,768 | A | 3/1913 | Levee et al. |
| 1,137,092 | A | 4/1915 | Sharp |

(Continued)

FOREIGN PATENT DOCUMENTS

| | | | |
|---|---|---|---|
| CN | 1233943 | 11/1999 | ..... A43B 13/40 |
| CN | 2688103 | 3/2005 | ..... A43B 17/08 |

(Continued)

OTHER PUBLICATIONS

"A Manual of Lower Extremities Orthotics", ed. Miles H. Anderson, pp. 109-111, 1972.

(Continued)

*Primary Examiner* — Alissa J Tompkins
*Assistant Examiner* — Cameron A Carter
(74) *Attorney, Agent, or Firm* — Hayes Soloway PC

(57) ABSTRACT

Provided is a shoe or device for inserting into a shoe, having a shallow channel on a top side of a contoured insole or shoe, specifically under the 1st metatarsal shaft of the wearer. The shoe also has a rear region or heel cup positioned to underlying a wearer's calcaneal tuberosity, the rear region being shaped to accommodate a planer surface of the wearer's calcaneal tuberosity, an upper surface of said rear region having a raised portion underlying an area of the wearer's calcaneus immediately forward of the wearer's calcaneus tuberosity.

17 Claims, 9 Drawing Sheets

(56) References Cited

U.S. PATENT DOCUMENTS 1,210,066 A 12/1916 Hara
1,287,810 A 12/1918 Wojteck
1,387,952 A 8/1921 Steinbrecher
1,550,715 A 6/1923 Stout
1,480,234 A 1/1924 Wedd
1,503,764 A 8/1924 Nickerson
1,544,625 A 7/1925 Austin
1,557,312 A 10/1925 Lelyveld
1,728,243 A 9/1929 Marshalek
1,760,300 A 5/1930 Donovan ..... 36/43
1,777,855 A 10/1930 Oblak ..... 36/43
1,819,539 A 8/1931 Bringardner
RE18,237 E 10/1931 Messier
1,827,044 A 10/1931 Simon
1,828,086 A 10/1931 Tweedie
1,847,287 A 3/1932 White
1,847,973 A 3/1932 Morton
1,864,999 A 6/1932 Gluckman
1,907,997 A 5/1933 Nickerson
1,957,695 A 5/1934 Chiapetta ..... 36/71
1,960,418 A 5/1934 Schaller ..... 36/71
1,992,081 A 2/1935 Madinger ..... 36/71
2,008,207 A 7/1935 Greenberg ..... 36/71
2,029,409 A 2/1936 Brand ..... 36/71
2,034,463 A 3/1936 Dvlinsky ..... 36/71
2,046,732 A 7/1936 Fein ..... 36/43
2,055,072 A 9/1936 Everston ..... 36/28
2,081,474 A * 5/1937 Burns ..... A43B 7/06 36/174
2,088,263 A 7/1937 Grouven ..... 36/8.5
2,092,910 A 9/1937 Daniels ..... 36/71
2,097,759 A 11/1937 Ehrlich ..... 36/71
2,119,807 A 6/1938 Farley ..... 36/71
2,246,944 A 1/1939 Larkin ..... 36/71
2,156,532 A 5/1939 Greider ..... 36/2.5
2,161,565 A 6/1939 Freda ..... 36/71
2,221,202 A 11/1940 Ratcliff ..... 36/71
2,252,936 A 8/1941 Leydecker ..... 12/142
2,255,100 A 9/1941 Brady ..... 36/71
2,304,384 A 12/1942 Stemmons ..... 36/71
2,346,279 A 4/1944 Stritter ..... 36/44
2,379,000 A 6/1945 Gould ..... 36/8.5
D143,642 S 1/1946 Bouthillette ..... D7/5
2,413,534 A 12/1946 Watson ..... 36/71
2,423,622 A 7/1947 Samblanet ..... 36/71
2,424,107 A 7/1947 McCahan ..... 36/71
2,460,493 A 2/1949 Diamant ..... 36/8.5
2,505,032 A 4/1950 De Voos ..... 36/11.5
2,588,317 A 6/1951 Schwartz ..... 36/76
2,628,440 A 2/1953 Leydecker ..... 36/71
2,658,288 A 11/1953 Scholl ..... 36/44
2,814,133 A 11/1957 Herbst ..... 36/71
2,821,032 A 1/1958 Helfet ..... 36/71
2,828,555 A 4/1958 Ledos ..... 36/71
2,863,231 A 12/1958 Jones ..... 36/71
2,897,611 A 8/1959 Schaller ..... 36/30
2,909,854 A 10/1959 Edelstein ..... 36/8.5
2,917,849 A 12/1959 Scholl ..... 36/71
2,928,193 A 3/1960 Kristan ..... 36/71
2,961,780 A 11/1960 McManus ..... 36/71
3,058,240 A 10/1962 Osgood ..... 36/91
3,068,872 A 12/1962 Brody ..... 128/595
3,084,695 A 4/1963 O'Donnell ..... 128/615
3,099,267 A 7/1963 Cherniak ..... 128/615
3,165,841 A 1/1965 Rollman ..... 36/2.5
3,187,069 A 6/1965 Pincus et al. ..... 264/45
3,233,348 A 2/1966 Gilkerson ..... 36/44
3,309,797 A 3/1967 Poitras ..... 36/80
3,333,353 A 8/1967 Garcia ..... 36/68
3,416,245 A 12/1968 Ferreira ..... 36/44
3,449,844 A 6/1969 Spence ..... 36/44
3,530,489 A 9/1970 Appleton ..... 36/44
3,591,882 A 7/1971 Pearsall ..... 12/146
3,638,336 A 2/1972 Silverman ..... 36/44
3,643,353 A 2/1972 Weight ..... 36/44
3,646,692 A 3/1972 Glogg ..... 36/2.5
3,680,162 A 8/1972 Glickman ..... 12/142
3,730,169 A 5/1973 Fiber ..... 128/2
3,781,231 A 12/1973 Janssen et al. ..... 260/2.5
3,832,793 A 9/1974 Siskin ..... 36/2.5
3,842,519 A 10/1974 Lapidus ..... 36/44
3,847,720 A 11/1974 Laberinti ..... 161/159
3,935,044 A 1/1976 Daly ..... 156/79
3,942,206 A 3/1976 Diamant ..... 12/142
4,003,146 A 1/1977 Meier et al. ..... 36/44
4,048,732 A 9/1977 Stix ..... 36/34
4,054,706 A 10/1977 Shapiro ..... 428/213
4,055,699 A 10/1977 Hsiung ..... 428/311
D246,551 S 12/1977 Hansjosten et al. ..... D2/320
4,073,024 A 2/1978 Stix ..... 12/142
4,084,333 A 4/1978 Del Vecchio ..... 36/43
4,101,704 A 7/1978 Hiles ..... 428/218
4,124,946 A 11/1978 Tomlin ..... 36/43
4,128,950 A 12/1978 Bowerman et al. ..... 36/30
4,137,654 A 2/1979 Hlavac ..... 36/119
4,168,585 A 9/1979 Gleichner ..... 36/95
4,187,621 A 2/1980 Cohen ..... 36/44
4,188,736 A 2/1980 Keller ..... 36/95
4,235,026 A 11/1980 Plagenhoff ..... 36/32
4,240,214 A 12/1980 Sigle et al. ..... 36/30
4,266,350 A 5/1981 Laux ..... 36/30
4,268,980 A 5/1981 Gudas ..... 36/43
4,272,899 A * 6/1981 Brooks ..... A43B 5/06 36/129
4,285,144 A 8/1981 Power ..... 36/44
4,291,428 A 9/1981 Anzani ..... 36/44
4,292,263 A 9/1981 Hanrahan et al. ..... 264/469.9
4,296,053 A 10/1981 Doerer et al. ..... 264/26
4,302,892 A 12/1981 Adamik ..... 36/31
4,307,521 A 12/1981 Inohara et al. ..... 36/31
4,316,335 A 2/1982 Giese et al. ..... 36/129
4,317,293 A 3/1982 Sigle et al. ..... 36/43
4,320,588 A 3/1982 Sottolana ..... 36/43
4,345,387 A 8/1982 Daswik ..... 36/43
4,346,205 A 8/1982 Hiles ..... 528/53
4,346,525 A * 8/1982 Larsen ..... A43B 7/144 36/145
4,360,027 A 11/1982 Friedlander et al. ..... 128/581
4,364,189 A 12/1982 Bates ..... 36/31
4,367,599 A 1/1983 Diamant ..... 36/44
4,372,059 A 2/1983 Ambrose ..... 36/32
4,377,041 A 3/1983 Alchermes ..... 36/30
4,378,642 A 4/1983 Light et al. ..... 36/35
4,398,357 A 8/1983 Batra ..... 36/30
4,408,402 A 10/1983 Looney ..... 36/43
4,418,483 A 12/1983 Fujita et al. ..... 36/28
4,435,910 A 3/1984 Marc ..... 36/44
4,451,949 A 6/1984 Long ..... 12/146
4,455,340 A 6/1984 Okina ..... 428/215
4,472,890 A 9/1984 Gilbert ..... 36/28
4,490,928 A 1/1985 Kawashima ..... 36/69
4,494,321 A 1/1985 Lawlor ..... 36/28
4,506,462 A 3/1985 Cavanagh ..... 36/92
4,510,700 A * 4/1985 Brown ..... A43B 7/142 36/154
4,510,702 A 4/1985 Ehrlich, Jr. ..... 36/86
4,513,518 A * 4/1985 Jalbert ..... A43B 7/142 36/178
4,515,851 A 5/1985 Johnson ..... 428/246
4,517,981 A 5/1985 Santopietro et al. ..... 128/581
4,527,345 A 7/1985 Lopez Lopez ..... 36/127
4,541,184 A 9/1985 Leighton ..... 36/44
4,541,186 A 9/1985 Mulvihill ..... 36/114
4,557,060 A 12/1985 Kawashima ..... 36/44
4,564,966 A 1/1986 Chen ..... 12/146
4,581,187 A 4/1986 Sullivan et al. ..... 264/46.4
4,586,273 A 5/1986 Chapnik ..... 36/44
4,597,195 A 7/1986 Dananberg ..... 36/28
4,608,988 A 9/1986 Dananberg ..... 128/581
4,627,177 A 12/1986 Meyers ..... 36/43
4,627,178 A 12/1986 Sullivan et al. ..... 36/44
4,631,841 A 12/1986 Hickey ..... 36/91
D288,621 S 3/1987 Surpunya et al. ..... D2/961
4,670,996 A 6/1987 Dill ..... 36/42

(56) References Cited

U.S. PATENT DOCUMENTS 4,674,204 A 6/1987 Sullivan et al. ..... 36/44
4,677,766 A 7/1987 Gudas ..... 36/43
4,682,425 A 7/1987 Simmons ..... 36/44
4,686,993 A * 8/1987 Grumbine ..... A43B 7/141 36/140
4,689,898 A * 9/1987 Fahey ..... A43B 5/06 36/144
4,769,926 A 9/1988 Meyers ..... 36/43
4,777,739 A * 10/1988 Hiles ..... A43B 7/1415 36/43
4,782,605 A * 11/1988 Chapnick ..... A43B 7/142 156/221
4,798,010 A 1/1989 Sugiyama ..... 36/30
4,813,157 A * 3/1989 Boisvert ..... A43B 7/142 36/145
4,835,884 A 6/1989 Bianchini et al. ..... 36/24.5
D302,764 S 8/1989 Peoples et al. ..... D2/318
4,852,275 A 8/1989 Bianchini et al. ..... 36/102
4,854,057 A 8/1989 Misevich et al. ..... 36/114
4,866,860 A 9/1989 Blissett et al. ..... 36/28
4,876,805 A 10/1989 Peoples ..... 36/43
4,910,866 A 3/1990 Sullivan et al. ..... 36/44
4,932,141 A 6/1990 Hones ..... 36/43
4,936,030 A * 6/1990 Rennex ..... A43B 13/18 36/102
4,955,148 A * 9/1990 Padilla ..... A43B 7/141 36/174
4,972,612 A 11/1990 Prukop et al. ..... 36/145
5,014,706 A 5/1991 Philipp ..... 128/581
RE33,648 E * 7/1991 Brown ..... A43B 7/142 36/154
5,063,692 A 11/1991 Suginaka ..... 36/43
D329,129 S 9/1992 Brown ..... D2/961
5,146,697 A 9/1992 Weiss ..... 36/12
5,174,052 A * 12/1992 Schoenhaus ..... A43B 7/14 36/144
5,184,409 A * 2/1993 Brown ..... A43B 7/142 36/173
D353,710 S 12/1994 Brazzell ..... D2/961
5,373,650 A * 12/1994 Dananberg ..... A43B 7/14 36/172
D362,956 S * 10/1995 Martin ..... D2/955
5,509,218 A 4/1996 Arcan et al. ..... 36/43
5,551,173 A 9/1996 Chambers ..... 36/141
5,584,130 A 12/1996 Perron ..... 36/44
5,632,104 A * 5/1997 Zohar ..... A43B 7/14 36/103
5,685,094 A * 11/1997 Lin ..... A43B 1/0054 36/141
5,722,186 A * 3/1998 Brown ..... A43B 1/0054 36/140
5,782,015 A 7/1998 Dananberg ..... 36/34
5,787,608 A * 8/1998 Greenawalt ..... A43B 3/128 36/11.5
5,787,610 A * 8/1998 Brooks ..... A43B 1/0027 36/169
6,000,147 A * 12/1999 Kellerman ..... A43B 7/142 36/160
6,041,524 A 3/2000 Brooks ..... 36/93
6,131,311 A * 10/2000 Brown ..... A43B 7/142 36/145
6,253,469 B1 7/2001 Atlani et al. ..... 36/174
6,282,816 B1 * 9/2001 Rosendahl ..... A43B 7/141 36/174
6,412,198 B1 7/2002 Rothbart ..... 36/144
6,510,626 B1 * 1/2003 Greenawalt ..... A43B 7/142 36/160
6,604,301 B1 * 8/2003 Manoli, II ..... A43B 7/141 36/144
6,889,452 B2 5/2005 Ailey et al. ..... 36/44
D513,358 S 1/2006 Amado et al. ..... D2/961
7,013,583 B2 * 3/2006 Greene ..... A43B 7/141 36/144
7,062,866 B2 * 6/2006 Bussler ..... A43B 7/142 36/102
7,124,520 B2 * 10/2006 Galbraith ..... A43B 7/144 36/43
7,200,955 B2 * 4/2007 Foxen ..... A43B 7/1425 36/25 R
7,264,604 B1 9/2007 Schuren et al. ..... 602/8
7,266,913 B2 * 9/2007 Axt ..... A43B 7/141 36/174
7,322,132 B2 * 1/2008 Dananberg ..... A43B 7/14 36/174
7,380,352 B2 * 6/2008 Seiter ..... A43B 7/1425 36/28
7,484,319 B2 * 2/2009 Cheskin ..... A43B 7/141 36/144
7,526,882 B2 * 5/2009 Rhenter ..... A43B 1/0045 36/174
7,594,346 B2 9/2009 Dananberg ..... 36/174
7,814,688 B2 10/2010 Dananberg ..... 36/174
7,962,986 B2 6/2011 Dananberg ..... 12/142 N
8,166,674 B2 5/2012 Dananberg ..... 36/43
9,055,781 B2 6/2015 Tzeng
9,460,557 B1 10/2016 Tran et al.
2004/0118017 A1 * 6/2004 Dalton ..... A43B 7/142 36/44
2005/0060909 A1 3/2005 Kerns et al. ..... 36/28
2008/0086909 A1 4/2008 Raspini ..... 36/44
2009/0049712 A1 2/2009 Steszyn et al. ..... 36/91
2009/0307925 A1 * 12/2009 Pfister ..... A43B 7/223 36/28
2010/0146816 A1 6/2010 Cappaert ..... 36/91
2010/0287795 A1 11/2010 Van Niekerk ..... A43B 13/14
2011/0035960 A1 * 2/2011 Werremeyer ..... A43B 7/142 36/28
2011/0185590 A1 * 8/2011 Nishiwaki ..... A43B 5/06 36/28
2012/0174436 A1 7/2012 Hanak ..... 36/43
2013/0104423 A1 5/2013 Hatfield ..... A43B 5/001
2013/0205620 A1 * 8/2013 Hsu ..... A43B 7/14 36/91
2013/0247418 A1 9/2013 Nurse ..... A43B 3/0031
2013/0283646 A1 * 10/2013 Selner ..... A43B 7/00 36/144
2016/0015120 A1 1/2016 Denison ..... A43B 3/0094
2017/0007160 A1 1/2017 Latterman ..... A61N 5/107
2017/0027277 A1 * 2/2017 Anthony ..... A43B 7/28

FOREIGN PATENT DOCUMENTS

CN 2770419 4/2006 ..... A43B 13/14
DE 22803 6/1883 ..... B41B 3/04
DE 660551 3/1938 ..... A43B 13/00
DE 875466 7/1949 ..... A43B 7/22
DE 397602 5/1994 ..... C07C 273/06
EP 427556 5/1991 ..... A43B 7/08
EP 591909 10/1993 ..... A43B 7/00
FR 1163646 9/1958 ..... A43B 13/48
FR 1207258 2/1960 ..... A43B 13/38
FR 1413280 4/1965 ..... A43B 13/41
FR 2015914 4/1970 ..... A43B 13/00
FR 2272618 3/1975 ..... A43B 7/00
FR 2309169 5/1975 ..... A43B 7/28
FR 2427801 6/1978 ..... A43B 21/32
FR 2506132 5/1981 ..... A41D 27/12
FR 2522482 1/1982 ..... A43B 17/14
GB 217833 6/1924 ..... A43B 17/00
GB 452492 11/1934 ..... A43B 13/38
GB 644712 10/1950
GB 1243575 8/1971 ..... A43B 17/14
GB 1564195 4/1980 ..... C08G 18/06
GB 2057964 4/1981 ..... B29D 9/06
GB 2088776 6/1982 ..... B32B 5/18
HU 209 953 2/1995 ..... A43B 13/40
JP 10-234417 8/1998 ..... A43B 17/00
JP 2001-523981 11/2001 ..... A43B 13/12
WO WO 91/07152 5/1991 ..... A61F 5/14
WO WO9200714 1/1992 ..... A61H 7/00
WO WO 98/14083 4/1998 ..... A43B 7/16

(56) References Cited

FOREIGN PATENT DOCUMENTS

| | | | |
|---|---|---|---|
| WO | WO9818358 | 5/1998 | A43B 7/22 |
| WO | WO 2004/012548 | 2/2004 | A43B 7/22 |
| WO | WO 2004/093584 | 4/2004 | A43B 7/38 |
| WO | WO2006043923 | 4/2006 | A43B 19/00 |
| WO | WO 2010/085485 | 7/2010 | A43B 13/14 |
| WO | WO2011017174 | 2/2011 | A43B 13/38 |
| WO | WO2016/178638 | 11/2015 | A43B 13/18 |
| WO | WO2016/185400 | 11/2016 | G06Q 30/02 |

OTHER PUBLICATIONS

"Anthropometry of the Foot and Lower Leg of U.S. Army Soldiers: Fort Jackson, SC—1985" NATICK/TR-92/028. Natick, Ma: U.S. Army Natick Research, Development, and Engineering Center (ADA261405), 1992 (360 pgs).
"Common Foot Disorders: Diagnosis and Management", ed. Donald Neale, pp. 44-47, 52-54, 65-66, 192-194, 1981.
"Lower Limb Orthotics: 1981 Revision", Prosthetics and Orthotics Department, New York University, Post-Graduate Medical School, pp. 172-179, copyright 1981.
"Mechanical Foot Therapy", Philip R. Brachman (The Leicht Press) pp. 292-295, 1946.
"New Styling for High-Heeled Comfort: The Classic Pump Redefined for Fashion Wear" Dananberg, Current Podiatric Medicine, 1990, pp. 29-32.
"Podopediatrics—The Care of Childrens Feet" by Herman R. Tax, B.S., Pod.D., Copyright 1947 ("Manual"), pp. Forward and 101-105 and 108-110.
"Shear Madness" Footwear News, vol. 53, No. 15 (2 pgs).
Chinese Search Report/Office Action (and translation) issued in related application No. 201080002797.9, dated Feb. 8, 2014 (40 pgs).
EP Communication dated Dec. 23, 2008 in EP Application No. 04 795 016.7, 5 pgs.
European Search Report issued in related application No. 10150628.5, dated Feb. 21, 2014 (5 pgs).
Herman R. Tax, D.P.M., "Podopediatrics", 1980, pp. 189, 221-242.
International Preliminary Report on Patentability issued in application No. PCT/US2004/033795, dated Apr. 26, 2007 (8 pgs).
International Preliminary Report on Patentability issued in corresponding application No. PCT/US2011/042044, dated Jan. 8, 2013 (8 pgs).
International Preliminary Report on Patentability, PCT/US2010/043578, dated Feb. 7, 2012 (11 pgs).
International Search Report and Written Opinion issued in application No. PCT/US04/10925, dated Mar. 8, 2005 (7 pgs).
International Search Report and Written Opinion issued in application No. PCT/US2004/033795, dated May 27, 2005 (16 pgs).
International Search Report and Written Opinion issued in application No. PCT/US16/33964, dated Aug. 31, 2016 (10 pgs).
International Search Report and Written Opinion, PCT/US2010/043578, dated Sep. 24, 2010 (15 pgs).
International Search Report and Written Opinion, PCT/US2011/042044, dated Feb. 7, 2012 (9 pgs).
Japanese Official Action (and translation) issued in related application No. 2012-523655, dated Jul. 31, 2014 (5 pgs).
Korean Office Action issued in application No. 10-2007-7010683, dated Sep. 29, 2011 (9 pgs).
Korean Office Action issued in application No. 10-2010-7022406, dated Oct. 19, 2011 (11 pgs).
Merton L. Root, D.P.M.; William P. Orien, D.P.M.; and John H. Weed, D.P.M.; normal and abnormal Function of the Foot, 1977, Clinical Biomechanics, vol. II, pp. 355-367.
Notice of Allowance issued in U.S. Appl. No. 10/964,532, dated Sep. 11, 2007 (9 pgs).
Notice of Allowance issued in U.S. Appl. No. 12/489,328, dated Aug. 30, 2010 (9 pgs).
Notice of Allowance issued in U.S. Appl. No. 12/489,328, dated Jul. 1, 2010 (16 pgs).
Notice of Allowance issued in U.S. Appl. No. 12/827,444, dated Dec. 14, 2010 (11 pgs).
Notice of Allowance issued in U.S. Appl. No. 12/827,444, dated Feb. 17, 2011 (7 pgs).
Notice of Allowance issued in U.S. Appl. No. 29/196,782, dated May 16, 2005 (6 pgs).
Notice of Allowance issued in U.S. Appl. No. 29/196,783, dated May 16, 2005 (6 pgs).
Notice of Allowance issued in U.S. Appl. No. 29/196,784, dated May 16, 2005 (6 pgs).
Notice of Allowance issued in U.S. Appl. No. 29/227,099, dated Jun. 19, 2006 (16 pgs).
Office Action dated Apr. 28, 2010 issued in related Mexican Patent Application No. MX/a/2007/004383 (2 pgs).
Office Action dated Feb. 15, 2008 issued in related Chinese Patent Application No. 200480044477.4 (7 pgs, with translation).
Office Action dated Nov. 1, 2010 issued in related Chinese Patent Application No. 200910150976.6 (7 pgs, with translation).
Office Action dated Nov. 21, 2008 issued in related Chinese Patent Application No. 200480044477.4 (6 pgs, with translation).
Office Action dated Nov. 4, 2009 issued in related Japanese Patent Application No. 2006-509840 (7 pgs, with translation).
Office Action dated Oct. 2, 2007 issued in related EPO Patent Application No. 04 737 224.8 (3 pgs).
Office Action issued in U.S. Appl. No. 10/421,403, dated Dec. 14, 2004 (6 pgs).
Office Action issued in U.S. Appl. No. 10/964,532, dated Apr. 13, 2007 (22 pgs).
Office Action issued in U.S. Appl. No. 12/489,328, dated May 20, 2010 (15 pgs).
Office Action issued in U.S. Appl. No. 15/057,925, dated Apr. 12, 2017 (5 pgs).
Office Action issued in U.S. Appl. No. 15/057,925, dated Apr. 20, 2018 (18 pgs).
Office Action issued in U.S. Appl. No. 15/057,925, dated Feb. 9, 2017 (15 pgs).
Office Action issued in U.S. Appl. No. 15/057,925, dated May 19, 2017 (15 pgs).
Office Action issued in U.S. Appl. No. 15/057,925, dated Nov. 29, 2017 (5 pgs).
Office Action issued in U.S. Appl. No. 15/057,925, dated Nov. 21, 2016 (29 pgs).
Office Action issued in U.S. Appl. No. 15/057,925, dated Sep. 22, 2016 (17 pgs).
Office Action issued in U.S. Appl. No. 15/356,256, dated Apr. 26, 2017 (32 pgs).
Office Action issued in U.S. Appl. No. 15/356,256, dated Feb. 23, 2017 (19 pgs).
Office Action issued in corresponding U.S. Appl. No. 15/057,925 dated Jan. 10, 2018, 25 pgs.
Official Action received in Applicant's related European Patent Application Serial No. 04737224.8, dated Sep. 13, 2010 (5 pgs).
Official Action received in Applicant's related Japanese Patent Application Serial No. 2006-509840, dated Jun. 22, 2010 (5 pgs).
Official Action received in Applicant's related Japanese Patent Application Serial No. 2007-536664, dated Aug. 10, 2010 (6 pgs).
Plastic Insole from Standing Ovation TM Shoes by HBN Shoe, LLC,1997; U.S. Appl. No. 29/196,783 (The "Artifact Sheet indicating an item has been filed which cannot be scanned" (dated Mar. 8, 2004) is provided in lieu of the original Plastic Insole) (1 pg).
Taiwanese Official Action (and translation) issued in related application No. 99125770, dated Mar. 27, 2015 (37 pgs).
Taiwanese Official Action (and translation) issued in related application No. 99125770, dated May 21, 2015 (22 pgs).
Office Action issued in U.S. Appl. No. 15/819,951, dated Jul. 26, 2018 (34 pgs).
Office Action issued in U.S. Appl. No. 15/819,951, dated May 16, 2018 (43 pgs).
U.S. Appl. No. 15/057,925, filed Mar. 1, 2016.
U.S. Appl. No. 15/356,256, filed Nov. 18, 2016.
U.S. Appl. No. 15/819,951, filed Nov. 21, 2017.
Office Action issued in U.S. Appl. No. 15/057,925, dated Aug. 31, 2018 (36 pgs).

(56) References Cited

OTHER PUBLICATIONS

International Search Report and Written Opinion issued in application No. PCT/US18/67313, dated Mar. 25, 2019 (9pgs).

* cited by examiner

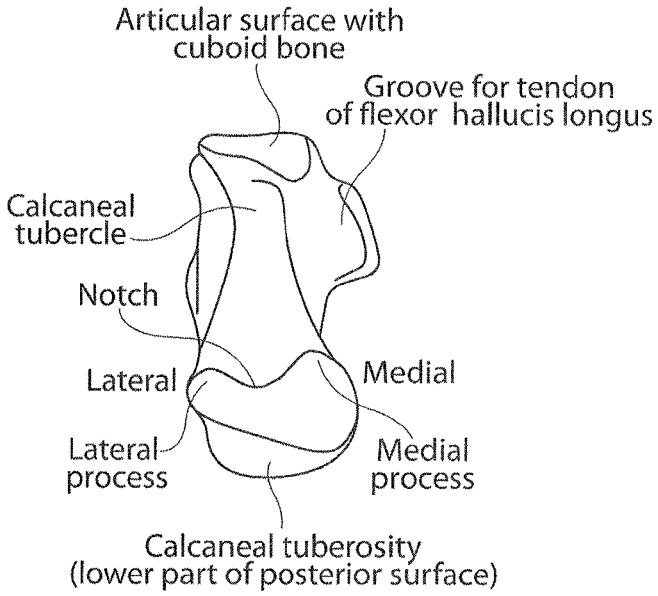
FIG. 1A
Prior Art
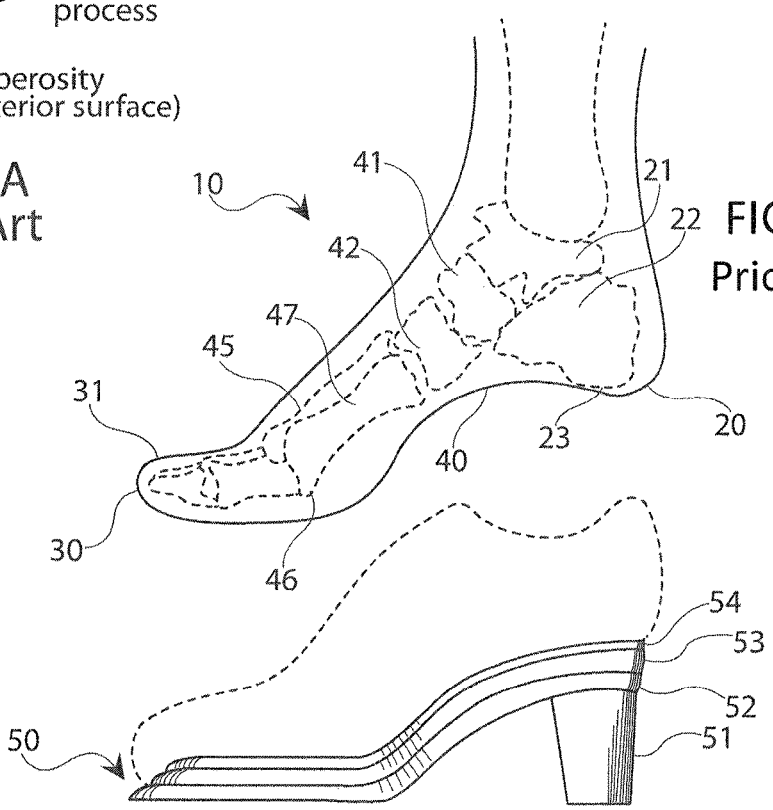
FIG. 1
Prior Art
FIG. 1C
Prior Art

DEVICE AND METHOD OF CONSTRUCTING SHOES

CROSS REFERENCE TO RELATED APPLICATION

Not applicable

STATEMENT REGARDING FEDERALLY SPONSORED RESEARCH OR DEVELOPMENT

Not applicable

BACKGROUND OF THE INVENTION

The present invention relates to a shoe that is easily constructed and provides greater comfort to the wearer without affecting the fit or style of the shoe.

In order to understand the prior art and the present invention, it is necessary to understand the anatomy of the foot and the basics of shoe construction. FIG. 1 is a diagrammatic medial side view of the bones of the human foot 10, FIG. 1A is a rearward or heel-end view of the bones of the human foot, and FIG. 1B is a top plan view of the bones of the human foot. For purposes of this application, references to heelward or rearward mean in the direction of the rear of the foot or heel 20; references to forward or toeward mean in the direction of the front of the foot 30 where the toes or phalanges 31 are located; references to medial mean the side of the foot where the arch 40 is located; references to lateral mean the outside of the foot; and references to upper or top and lower, bottom or under assume the foot or shoe is oriented in an upright position.

The heel 20 of the foot (also known as the tarsus) includes the talus 21 and the calcaneus 22 bones. The rear lower surface of the calcaneus 22 has a slight protuberance 23 known as the calcaneal tuberosity.

Referring to FIG. 1A, the calcaneus is an irregularly shaped quadrangular bone also called the heel bone or os calcis. As can be seen particularly in FIG. 1A, the medial side of the calcaneal tuberosity, i.e. the lower part of the posterior surface of the calcaneus is not precisely on the same ground or plane as the lateral tuberosity. This slight difference in calcaneal anatomy leads to potential for instability on level surfaces, such as sidewalks, gym floors, hardwood, etc.

Referring also to FIG. 1B, the bones of the foot also include the navicular 41, the cuneiform 42, the metatarsals 45A-45E and the phalanges, or toes 31A-31E, with the big toe 31A visible in FIG. 1. The metatarsal heads 46A-46F are located at the forward end of the metatarsal shafts 47A-47E. Although it's one of the smaller parts of the body, all told the foot contains 26 bones, 33 joints and more than 100 muscles. Together, a person's two feet contain more than a quarter of all the bones in the human body which interact and undergo significant stresses during standing, walking and running.

Human footwear is designed to protect the human foot. However, as currently designed, human footwear is imperfect in providing proper biomechanical support for the human foot.

Also depicted in FIG. 1C is a partial cross-sectional view of the portions of a conventional shoe 50 that underlie the sole of the foot, the top parts of the shoe being shown in phantom. Shoe 50 has a heel 51 which is attached to the lower surface of sole 52 of shoe 50, with the sole 52 in turn supporting an insole board 53 on which a sock liner 54 is placed. In a conventional shoe, the insole board typically is of relatively rigid construction from the region underlying the wearer's heel to the heads of the metatarsals. Sock liners are commonly very flexible and generally are very thin, typically no more than half a millimeter thick. The sock liner is the surface upon which the sole of the foot normally rests.

In prior U.S. Pat. No. 4,597,195 to Dananberg (the '195 patent), there is described a human shoe sole having an area of reduced support underlying substantially only the location of the first metatarsal head of the wearer's foot. As described in the '195 patent, providing an area of reduced support substantially only under the head of the first metatarsal encourages eversion and plantar flexion of the first metatarsal head as weight shifts from the heel to the first ray. Thus, normal functioning of the foot for plantar flexion and supination is encouraged with beneficial results for improved walking comfort and shock absorption on subsequent heel contact. Prior PCT application WO 2011/017174 A1 describes an improvement in a human shoe sole or insole in which a depression provided underlying the first metatarsal head in which the depression has its lowest point skewed to the medial side of center. Millions of pairs of shoes have been manufactured and sold incorporating relief under the first metatarsal head as described above.

BRIEF SUMMARY OF THE INVENTION

The present invention provides improvements over current footwear products in terms of function and comfort. In one aspect, the present invention provides significant improvement in terms of biomechanical functioning of the footwear product, resulting in increased comfort to the wearer, by providing a shallow channel on the top side of a contoured insole or shoe insert, specifically under the $1^{st}$ metatarsal shaft. In the heelward to toeward direction, the channel is rotated 4±1 degrees plantargrade, with the toeward end lower than the heelward end. In the lateral to medial direction the channel slopes down about 9±2 degrees. The channel is not symmetrical side to side either, but rather rotated 10±5 degrees clockwise on the left and 10±5 degrees counterclockwise on the right. The variation in rotation can be used to accommodate a variety of different types of feet, from high to low arches. In low arched feet, the rotation would be greater as there is far less metatarsal head plantarflexion-eversion. In high arch feet, the rotation would be at the lower end of the rotation, as the $1^{st}$ metatarsal is already plantarflexed.

The shallow channel is located on the top side of a 2-6 mm thick insole, which is trimmed to end behind the metatarsal heads and with a small $1^{st}$ metatarsal recess. The channel also may be formed in a full length insole where a "step-down" of between 2-4 mm is placed at the metatarsal head locations across the ball of the foot. The step-down or thinner area is towards the toes and the thicker section towards the heel.

Alternatively, the channel may be located on the top side of an insole which has a raised "dome" 2 to 6 mm high in which the highest point is located between the $1^{st}$ and $2^{nd}$ metatarsal shafts rearward of the first and second metatarsal heads, and which is trimmed to end rearward of the metatarsal heads and with a small $1^{st}$ metatarsal recess. The channel also can be placed on a full length insole where a "dome" is placed behind the metatarsal head locations across the ball of the foot, and the insole extends back under the heel of the foot.

The invention also preferably includes modifying the heel area or heel cup area of footwear to reduce the pressure on the plantar fascia of the wearer as it travels from its attachment on the medial calcaneus to the proximate phalanges, as will be described below, and includes a slightly raised (0.5-2 mm thick) region forward a slightly hollowed or depressed heel cup region (1-3 mm deep), adapted to underlie the heel of the wearer. The hollowed or depressed heel cup region is asymmetrical with its lowest region located to the medial side of the heel, and has a forward extension on the heel cup medial side.

The foot supporting surface can be built into the shoe, i.e. by providing a contoured insole board. Alternatively, the modified foot supporting bed may be provided as a separate piece which may be applied at the factory, or applied by the consumer after-market. Moreover, in the case of molded sandals and flip-flops, the foot supporting surface can be formed integrally with or cut out of the foot bed forming the sandal or flip-flops.

Stated another way, the device may be formed integrally with the foot bed of the shoe, as a shaped insole, or as a separate device. As used herein, "device" is intended to refer to all three.

The device is left/right shoe specific, wherein the left and right shoe pieces preferably are mirror images of one another.

BRIEF DESCRIPTION OF THE DRAWINGS

Further features and advantages of the present invention can be seen, in detailed description, taken in conjunction with the accompanying drawings, wherein:

FIG. 1 is a diagrammatic cross-sectional view of bones of a human foot;

FIG. 1A is a rear view of the calcaneus bones of a human foot;

FIG. 1C is a cross-sectional view of portions of a conventional shoe;

DETAILED DESCRIPTION OF THE INVENTION

Figure 1B:
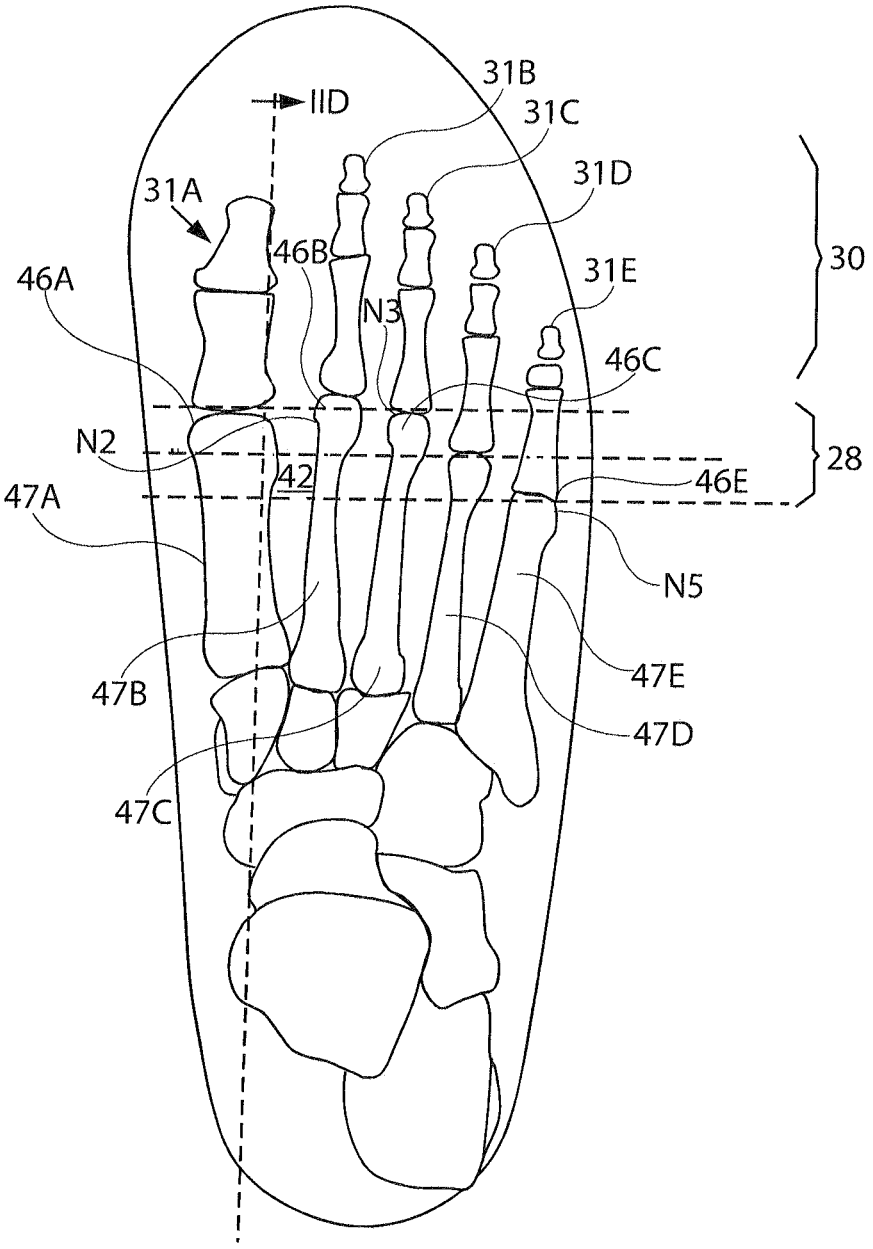
FIG. 1B Prior Art
FIG. 1B is a top plan view of the bones of a human foot.
Figure 3:
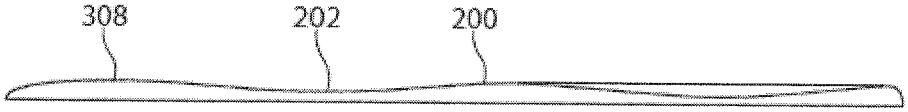
FIG. 3 is a side sectional view of a foot supporting insole taken along lines III-III of FIG. 2.

As used herein the term "sole" and "insole" are used interchangeably. Moreover, a "sole" or "insole" may be an element built into or forming an integral element of a footwear product such as an insole board, or as a separate element including, e.g. a sock liner or a removable insole, and after-market insole device, and after-market heel device, or a custom or prefabricated foot orthotic which may be inserted into a footwear product post-manufacturer. The heel element also may be formed directly in the foot supporting surface of a shoe, i.e. such as in the case of a molded sandal or flip-flop.

In one embodiment, the foot supporting surface comprises a separate element or device. In such embodiment, the device may be sized and shaped to conform to the shape of the sock liner or insole board. Optimally, in such embodiment, the device is narrower than the sock liner when it is to be positioned under the sock liner. This narrower size allows the edge of the sock liner to be adhered to the insole board along the edges of the device of the invention. Depending on the style of the shoes this narrower configuration may be particularly desirable. In other embodiments, described below, the device may be formed integrally with the sock liner, foot bed or insole board, or in the case of a molded footwear product such as a sandal or flip-flop, formed integrally as part of the foot supporting surface.

The device has a depressed area adapted to underlie the heel of the wearer, shaped generally to accommodate the wearer's calcaneal anatomy. The heel cup includes a forward extension on the medial side, which functions to reduce pressure on the plantar fascia as it travels from its attachment on the medial calcaneus to the proximal phalanges.

Referring in particular to FIGS. 2A, 2B, 3, 5 and 6A-6G, the device, which typically is 2-5 mm thick, includes a heel cup 135 in the form of lop-sided generally round shaped depression 136, with its lowest region 137 located slightly to the medial side of the heel. Heel cup 135 is generally round in plan, and includes a forward depressed extension region 138 on its medial side, which serves to reduce pressure on the plantar fascia of the wearer's foot, as it travels from its attachment on the medial calcaneus to the proximal phalanges. Heel cup 135 typically is 1-4 mm deep at its lowest point, preferably 2-3.5 mm deep, more preferably 2.5-3 mm deep. The region immediately forward heel cup 135 is raised relative to depression 136. Continuing toeward, the device is then slightly thinned to a bridging area under the arch of the wearer, and then rises again to the region 140 adapted to underlie the metatarsal heads of the wearers foot. Preferably the region 137 of heel cup 135 is elongated and rotated 3±2 degrees clockwise on the left, and 3±2 degrees counterclockwise on the right.

Figure 2B:
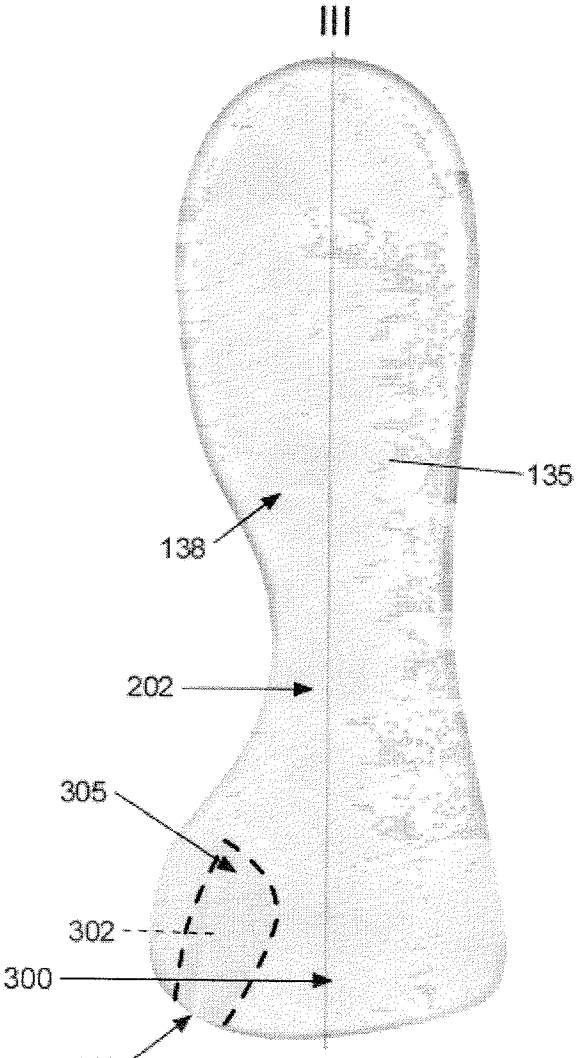
FIGS. 2A and 2B are a top plan views of a left foot supporting insole for a men's shoe in accordance with one embodiment of the present invention, the right foot supporting insole being a mirror image thereof.
Figure 2A:
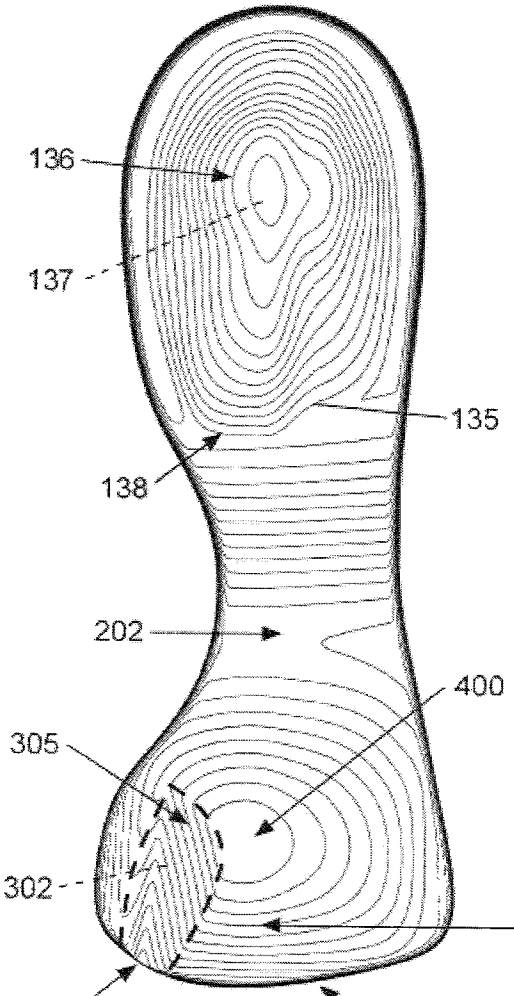
Figure 4B:
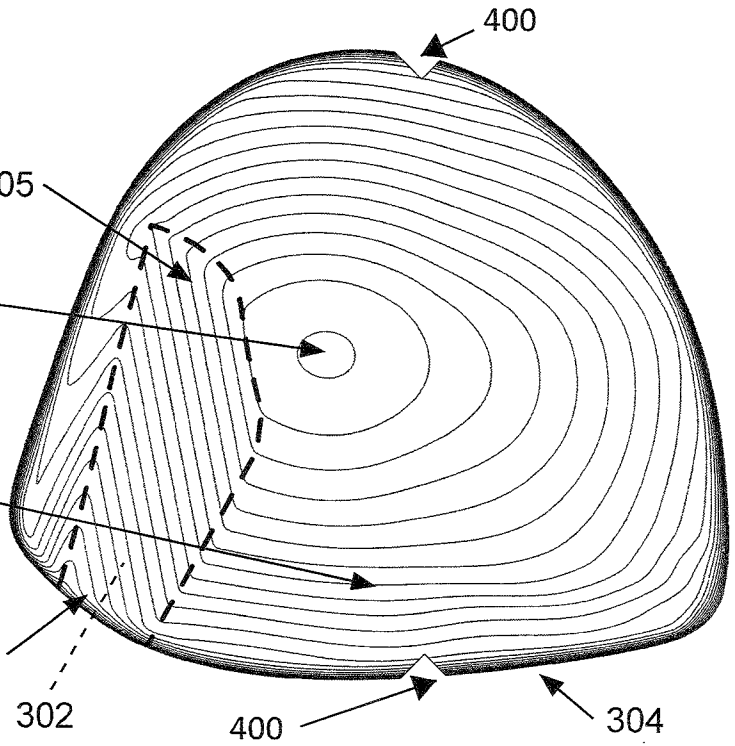
FIG. 4B is an enlarged view of an alternate stand alone embodiment encompassing only a contoured forefoot portion for a woman's shoe with contour lines taken at 0.2 mm superimposed thereon.
Figure 4A:
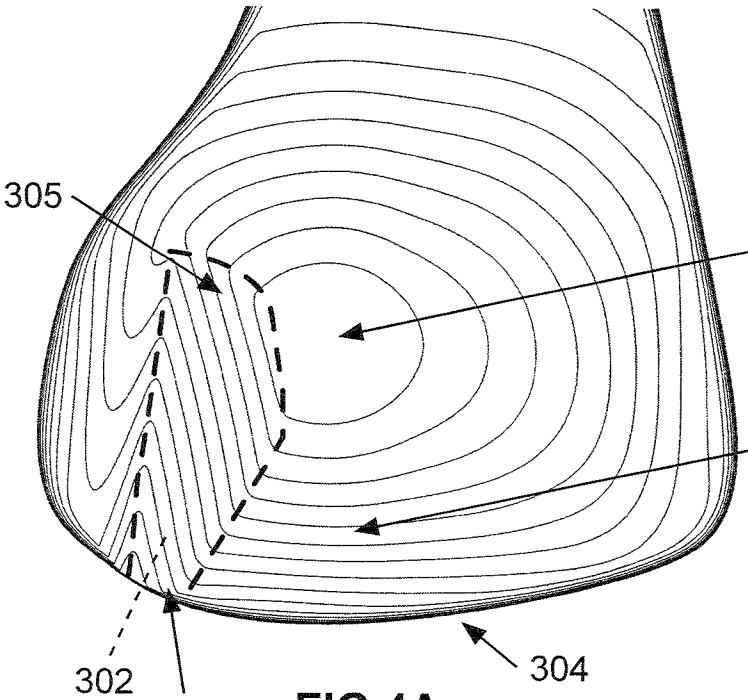
FIG. 4A is an enlarged view of the forefoot portion of the foot supporting insole for a men's shoe of FIGS. 2A and 2B with contour lines taken at 0.2 mm superimposed thereon.
Figure 5:
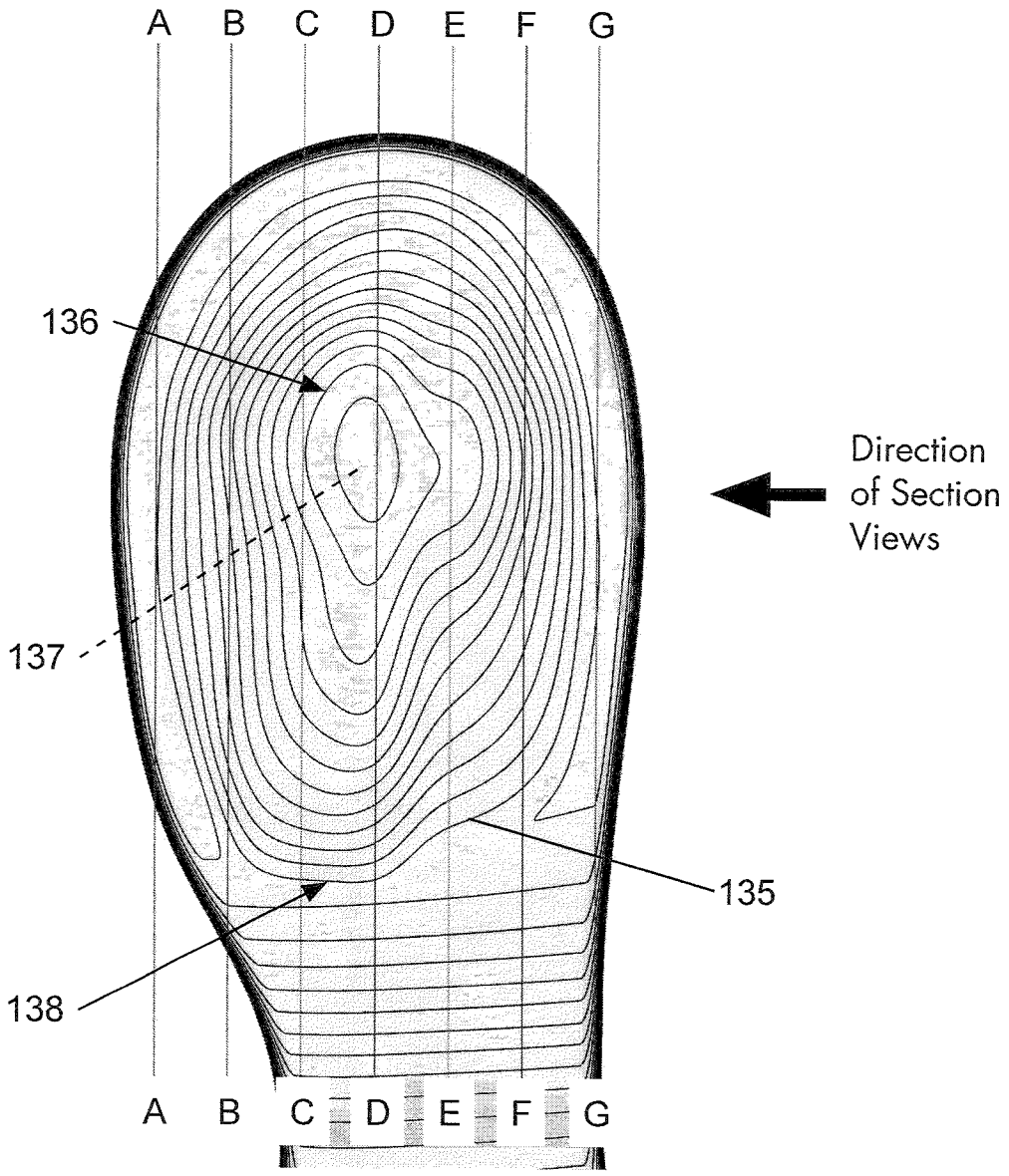
FIG. 5 is a view, similar to FIG. 4, but showing the heel portion of the right foot supporting insole of FIGS. 2A and 2B, with contour lines taken at 0.2 mm superimposed thereon.
Figures 6A, 6B, 6C, 6D, 6E, 6F, 6G:
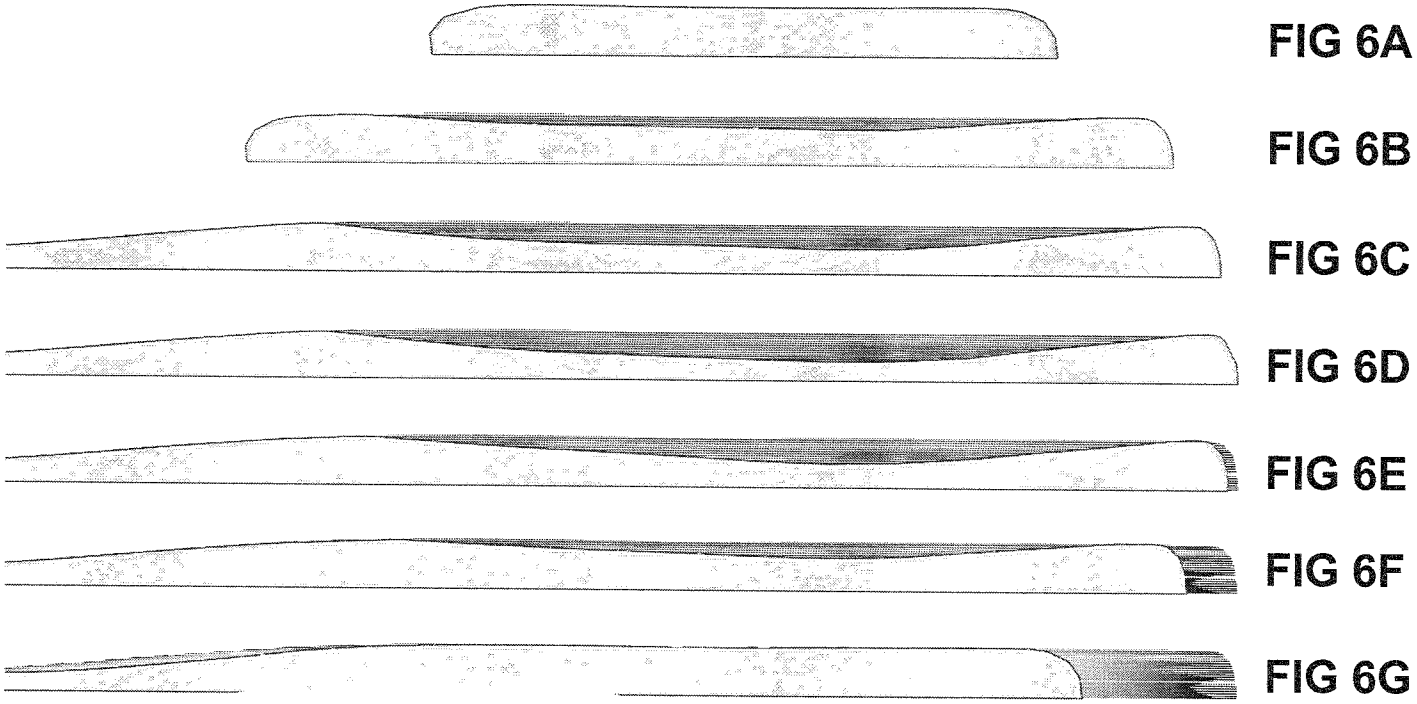
FIGS. 6A-6G are cross-sectional views taken along lines A-A through G-G of FIG. 5.

Referring to FIGS. 2A & 2B and 4A, the toeward region 300 of the device, extends forward under the metatarsal shafts to just short of the metatarsal heads. A shallow channel 302 is located on the top side of the device adapted to underlie the first metatarsal shaft in part. Channel 302 is subtly rotated 4±1 degrees plantargrade in the heelward to toeward direction, with the toeward end 303 lower than the heelward end 305. In the lateral to medial direction channel 302 slopes down 9±2 degrees. This same channel 302 is not symmetrical side to side either, but rather rotated 10±5 degrees clockwise on the left and 10±5 degrees counterclockwise on the right. The variation in rotation accommodates a variety of different types of feet, from high to low arches. In lower arched feet, the rotation is greater as there is far less metatarsal head plantarflexion-eversion. In higher arch feet, rotation is at the lower end of the rotation, as the $1^{st}$ metatarsal is already plantarflexed.

Channel 302 which has a maximum depth of 1-3 mm, can be located on the top side of a flat 2-4 mm thick insole, which is trimmed at its toeward end 304 to end just behind all 5 metatarsal heads channel 302 is deepest at its toeward end 303 to accommodate, in part, the $1^{st}$ metatarsal head of the wearer. Channel 302 also can be formed in a full length insole where a "step-down" of between 2-4 mm is located at the metatarsal head locations across the ball of the foot. The thinner area is towards the toes and the thicker section towards the heel.

In other words, channel 302 is located on the top side of an insole which may include a "dome" 308, 2 to 5 mm high in which the highest point 400 is located to lie between the $1^{st}$ and $2^{nd}$ metatarsals, and which extends to just behind all 5 metatarsal heads and is widest and deepest at its toeward end 303, to accommodate, in part, the $1^{st}$ metatarsal head of the wearer. Channel 302 also can be formed in a full length insole where the "dome" 308 is located behind the metatarsal head locations across the ball of the foot, and the insole extends back under the heel of the foot.

A similarly shaped channel 302A may be formed in a "quarter" length insole where the "dome" 308 is located behind the metatarsal head locations across the ball of the foot, and the insole is trimmed at its heel ward end before it reaches the thinnest point 202, as shown in FIG. 4B.

In such embodiment, a pair of alignment notches 400 may be added to aid with proper alignment in the shoe since in this embodiment the forefoot section cannot rely on the under heel section of the full length device for proper alignment.

The insoles described above may be used with street and sport footwear including sandals. As noted above, the insoles may be incorporated into an insole board at the time of manufacture, formed as a sock liner or as an aftermarket insole device or a custom or prefabricated (over-the-counter) orthotic for placing into a shoe by the wearer.

Preferably, the upper surface of the device is smoothly contoured, with no sharp transitions or edges that could contribute to discomfort. Specifically, the transition between the apices of the raised areas and the surrounding areas of the device are filleted and smooth.

Figure 7A:
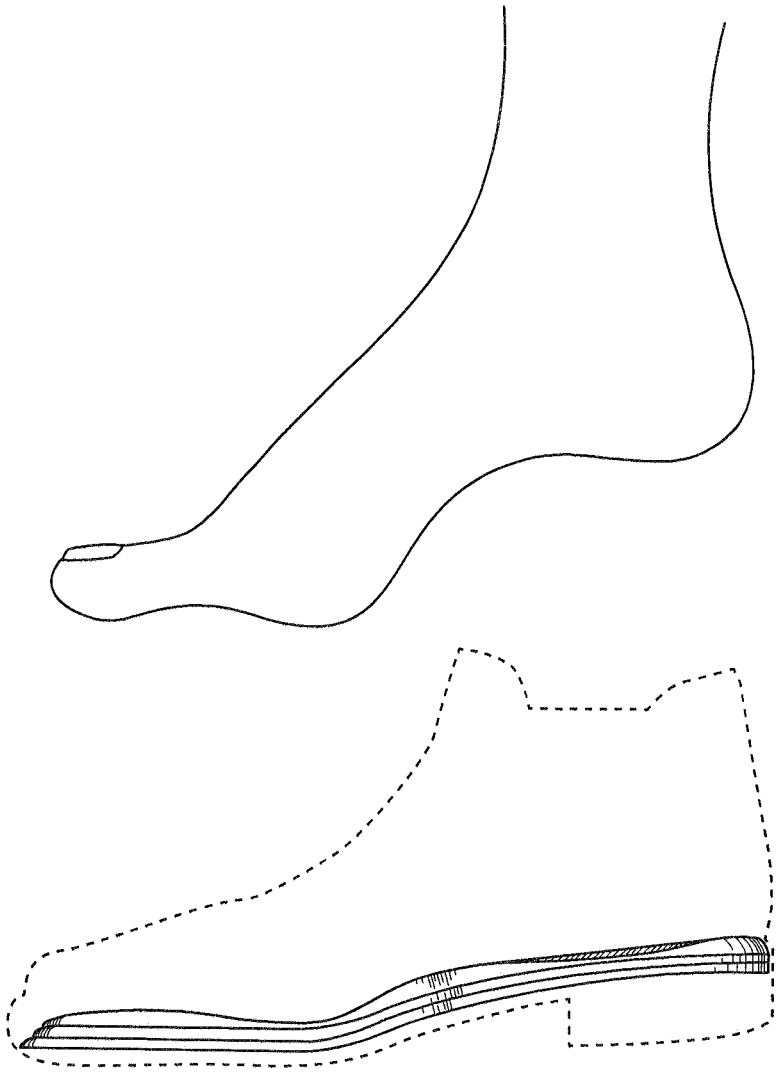
FIGS. 7A-7C are cross-sectional views of various foot wear products incorporating a foot supporting insole in accordance with the present invention.
Figure 7B:
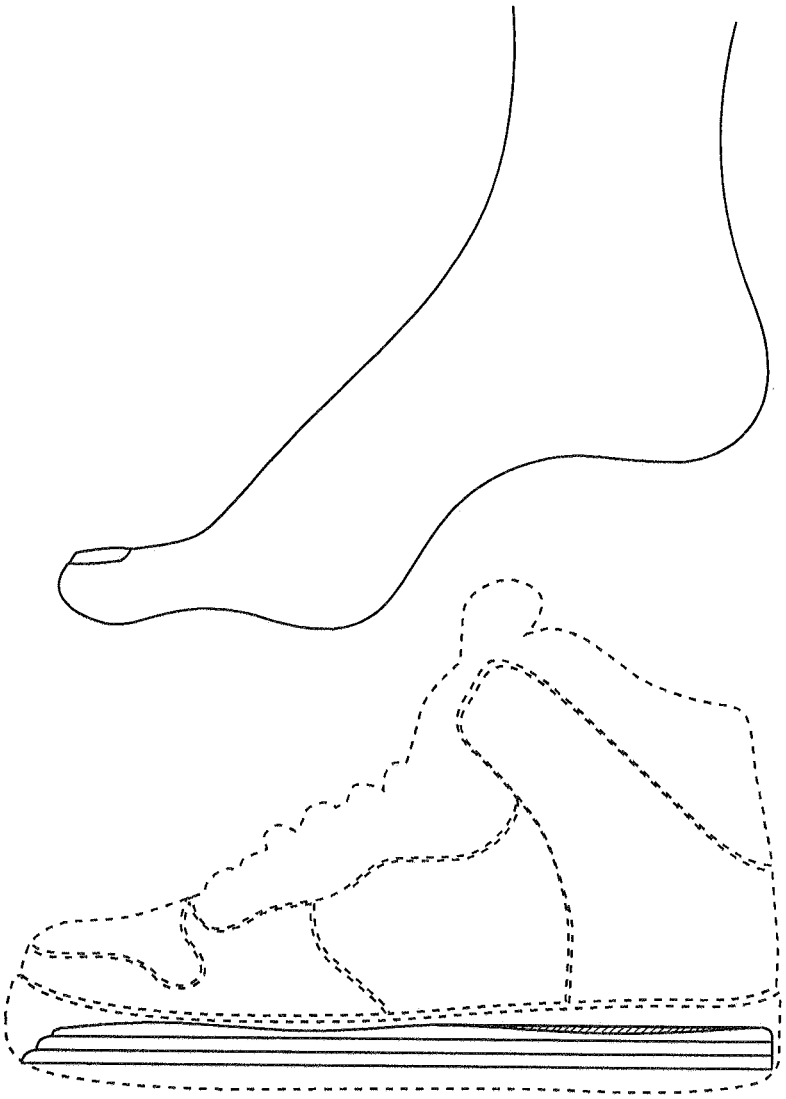
Figure 7C:
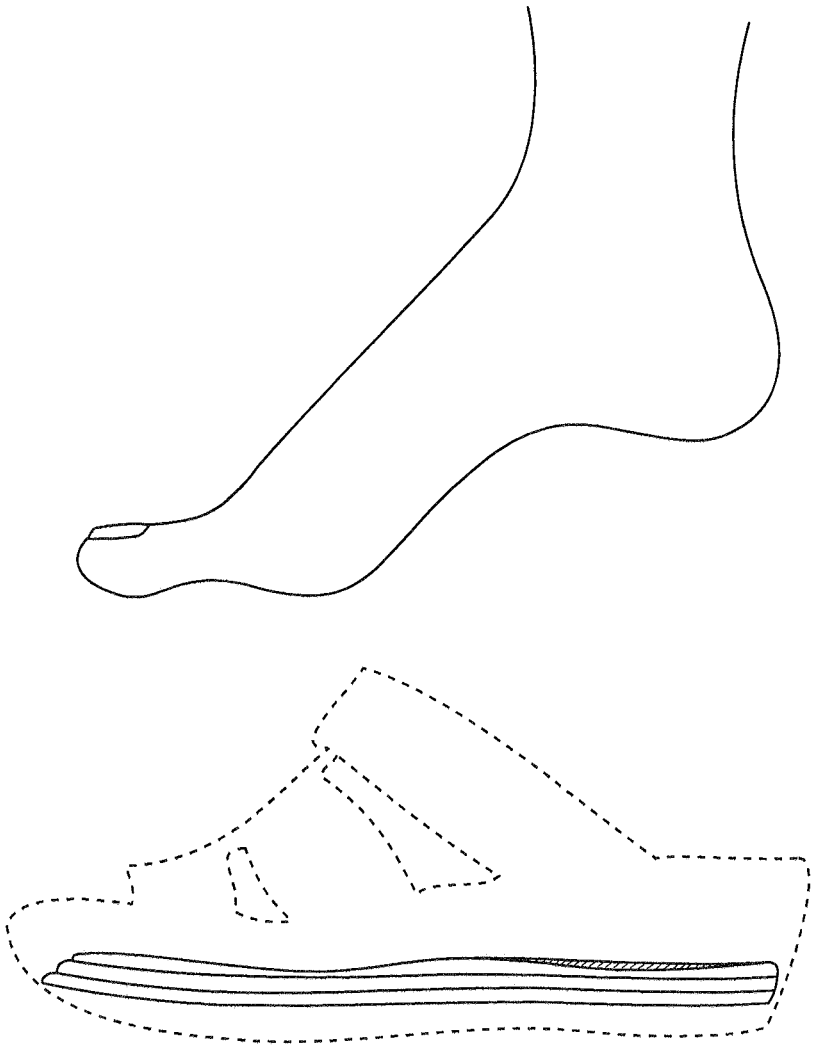

FIGS. 7A-7C shows the device may be formed as an integral part of a footbed, or insole or separate component of, for example, a street shoe (FIG. 7A) or athletic shoe (FIG. 7B) or built directly into the foot supporting surface of a loafer, sandal or flip-flop (FIG. 7C).

Providing a loafer, sandal or flip-flop with a channel underlying the first metatarsal shaft as above described, and with lop-sided heel cup as above described, significantly increases user comfort, and improved the biomechanics of wearer on walking.

Various changes may be made in the foregoing invention without departing from the spirit of the scope thereof.

The invention claimed is:

1. A shoe or device for insertion into a shoe having a foot supporting upper surface, wherein the shoe or device has an upward facing shallow channel on the foot supporting upper surface adapted to underlie the first metatarsal shaft and heelward of the first metatarsal head of the wearer, wherein the channel is adapted to specifically extend in a direction from the toe end of the shoe heelward only under the first metatarsal shaft to short of the first metatarsal head of the wearer, and is pitched or rotated 4±1 degrees plantargrade, with a toeward end of the channel lower than the heelward end of the channel, and wherein the channel is rolled or sloped in a lateral to medial direction downward 9±2 degrees, in the frontal plane, and wherein the channel is yawed or rotated 10±5 degrees clockwise relative to a superior view of the transverse plane, for the left foot shoe, and yawed or rotated 10±5 degrees counterclockwise relative to a superior view of the transverse plane for the right foot shoe, and wherein the shoe or device is contoured and has a dome or raised area supporting surface having its highest point configured to underlie between the first and second metatarsal shafts rearward of the first and second metatarsal heads of the wearer.

2. The shoe or device of claim 1, wherein the channel is rotated about 0.5-3 degrees plantargrade.

3. The shoe or device of claim 1, wherein the channel is rotated about 5-7 degrees plantargrade.

4. The shoe or device of claim 1, wherein the channel is sloped in a lateral to medial direction downward 2-7 degrees.

5. The shoe or device of claim 1, wherein the channel is sloped in a lateral to medial direction downward 11-16 degrees.

6. The shoe or device of claim 1, wherein the channel is rotated 1 to 5 degrees clockwise relative to a superior view of the transverse plane for the left foot, and 1 to 5 degrees counterclockwise relative to a superior view of the transverse plane for the right foot.

7. The shoe or device of claim 1, wherein the channel is rotated 15 to 20 degrees clockwise relative to a superior view of the transverse plane for the left shoe and 15 to 20 degrees counterclockwise relative to a superior view of the transverse plane for the right shoe.

8. The shoe sole or device of claim 1, in the form of an insole or orthotic, or sock liner.

9. The shoe sole or device of claim 1, wherein the channel has a maximum depth of 0.5-5 mm.

10. The shoe or device of claim 1, further comprising:

a heel cup having a supporting surface configured to underlie a wearer's heel, the heel cup being generally circular in plan, and having a forward extension on its medial side configured to reduce pressure on the wearer's plantar fascia between the wearer's medial calcaneus to the wearer's proximal phalanges.

11. The device of claim 10, wherein the heel cup is asymmetrical, with its lowest region located to the medial side of the heel.

12. The device of claim 11, wherein the heel cup lowest region is elongated and it rotated 4±3 degrees clockwise on the left, and 4±3 degrees counterclockwise on the right.

13. The device of claim 10, wherein the heel cup is 1-5 mm deep at its lowest point.

14. The device of claim 10, wherein the channel and the heel cup are formed integrally with the foot supporting surface of the shoe.

15. The device of claim 1, wherein the device is left and right shoe specific.

16. The device of claim 15, wherein the left and right shoe pieces are mirror images of one another.

17. The device of claim 1, wherein the shoe is a loafer, sandal or flip-flop, and the channel is formed integrally with the foot supporting surface.

* * * * *